US005695416A

United States Patent [19]

Christian

[11] Patent Number: 5,695,416

[45] **Date of Patent: *Dec. 9, 1997**

[54] HOCKEY STICK AND HOCKEY STICK REPLACEMENT BLADE

[75] Inventor: William D. Christian, Warroad, Minn.

[73] Assignee: Christian Brothers, Inc., Warroad, Minn.

[ * ] Notice: The term of this patent shall not extend beyond the expiration date of Pat. No. 5,628,509.

[21] Appl. No.: 719,137

[22] Filed: Sep. 24, 1996

Related U.S. Application Data

[63] Continuation-in-part of Ser. No. 533,602, Sep. 25, 1995, Pat. No. 5,628,509.

[51] Int. Cl.[6] ..... A63B 59/14

[52] U.S. Cl. ..... 473/562

[58] Field of Search ..... 273/67 A, 81, 273/80.1; 473/307, 310, 560–563

[56] References Cited

U.S. PATENT DOCUMENTS 3,638,942 2/1972 Bassett ..... 473/562

FOREIGN PATENT DOCUMENTS 2060962 8/1992 Canada ..... 273/67 A
3012300 10/1981 Germany ..... 273/67 A

*Primary Examiner*—Mark S. Graham
*Attorney, Agent, or Firm*—Dorsey & Whitney LLP

[57] ABSTRACT

A hockey stick having a shaft with a hollow connection end, a blade with a connection tenon and a friction member carried by the tenon for retaining the shaft relative to the blade when the tenon is inserted into the hollow connection end. The invention also relates to an adhesive free method of connecting a hockey stick replacement blade to a hockey stick shaft.

12 Claims, 2 Drawing Sheets

Fig. 1
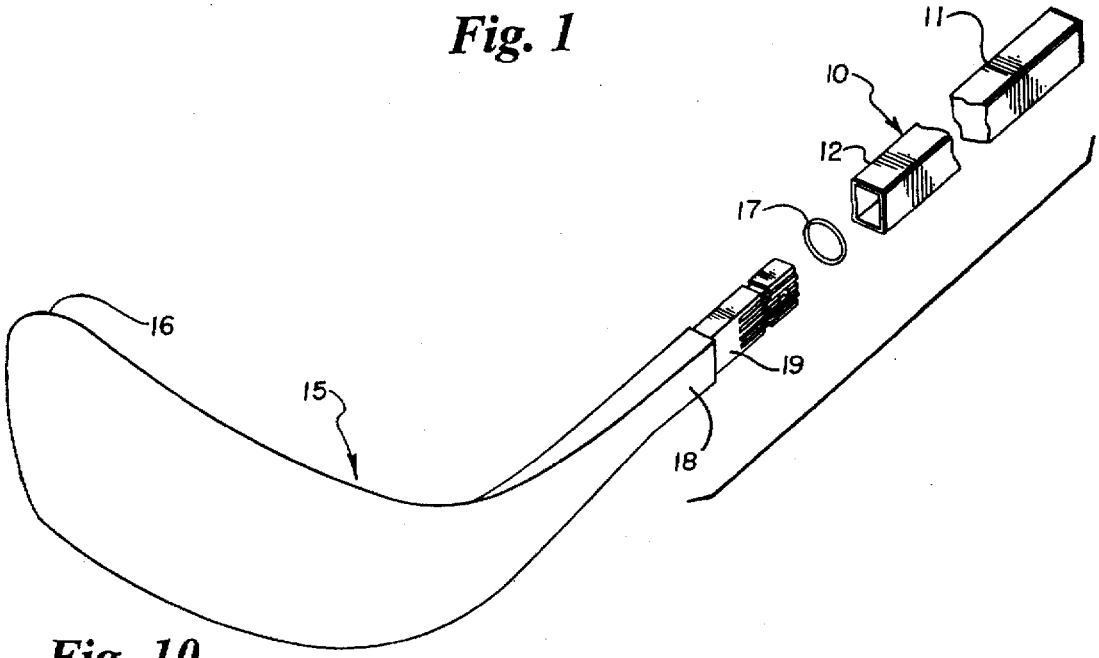
Fig. 10
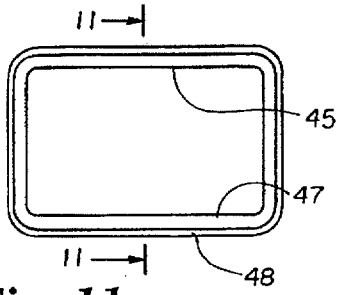
Fig. 2
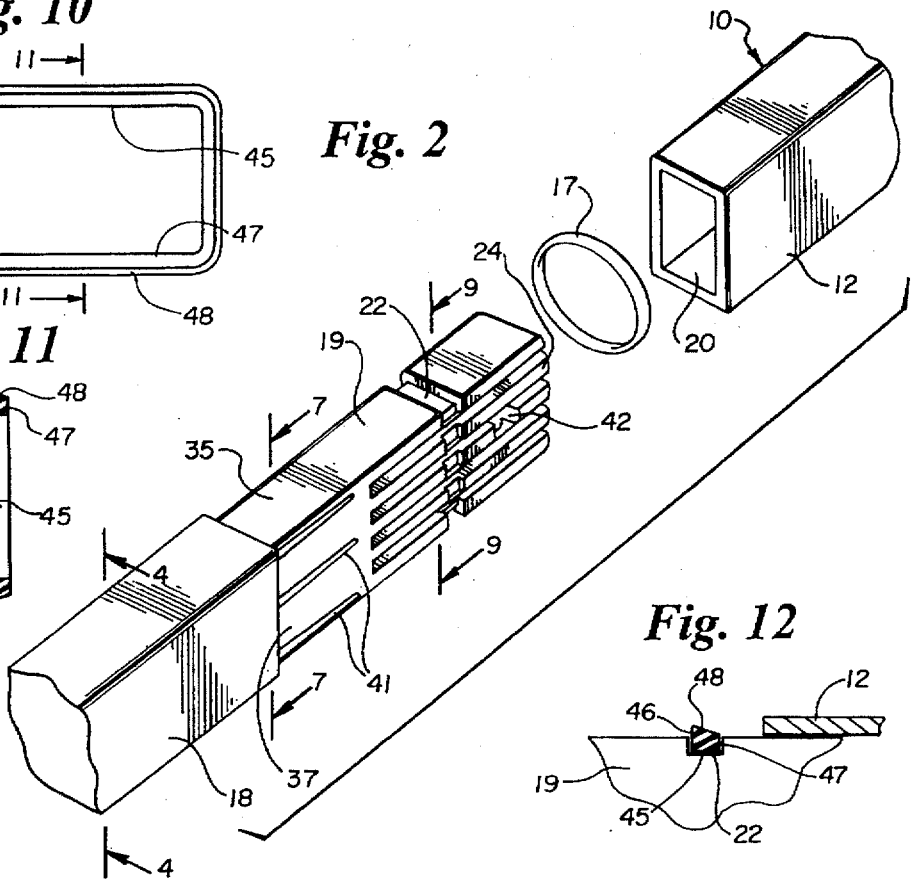
Fig. 11
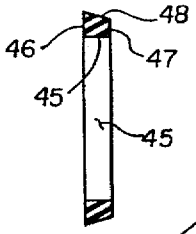
Fig. 12

HOCKEY STICK AND HOCKEY STICK REPLACEMENT BLADE

This is a continuation-in-part application of Ser. No. 08/533,602 filed Sep. 25, 1995, U.S. Pat. No. 5,628,509.

BACKGROUND OF THE INVENTION

1. Field of the Invention

The present invention relates generally to a hockey stick construction and more particularly to a hockey stick replacement blade with adhesive free means for connecting the blade to a hockey stick shaft. The invention also relates to an adhesive free method of connecting a hockey stick replacement blade with a hockey stick shaft.

2. Description of the Prior Art

Hockey sticks in general have experienced dramatic changes throughout the years. As a result, ice hockey sticks have evolved from plain wooden sticks having a straight blade and shaft to sticks having a curved blade and fiberglass reinforcement. The construction of hockey sticks has also evolved substantially. Initially, the shaft and blade portions were constructed of wood and were integrally joined with one another through various processes known in the art. As technology developed, metal shafts, particularly aluminum shafts, were introduced as a substitute for the traditional wooden shafts. These shafts were elongated and were constructed of a tubular section of aluminum or other light weight metal. Shafts of this type were used with replacement blades having a blade replacement tenon for insertion into the hollow aluminum shaft and secured in that position by various forms of heat sensitive adhesives.

Plastic or composite shafts have also been developed. Like aluminum shafts, they are elongated and generally hollow and are secured to a replacement blade in a manner similar to aluminum shafts utilizing various forms of heat sensitive or other adhesives. Replacement blades have also undergone evolution from wooden blades to blades constructed of various plastics and other synthetic materials. In recent years, hockey sticks have been developed for street or roller hockey. Initially, many of the sticks used in roller or street hockey were constructed solely of plastic with an integral shaft and blade. As this sport continued to evolve, however, aluminum and plastic or composite shafts were designed for use with replacement blades similar in design to those used for ice hockey and, in some cases, interchangeable with ice hockey replacement blades. For the most part, however, the mechanism for connecting replacement blades to the hollow metal or plastic shafts involved providing the replacement blade with a tenon and securing the blade to the shaft through the use of a heat sensitive or other adhesive disposed between the tenon and the hollow interior of the shaft.

Because of the nature of the adhesives used, it has been necessary to heat the shaft or blade, and thus the adhesive, so that the adhesive softens or liquifies in order to connect a blade to the shaft or to remove a blade from the shaft for replacement by another. In many cases heat is applied by means of a blow torch or other similar device. However, a blow torch is not desirable for use with plastic blades or shafts. More recently heat guns and other devices have been developed for heating the shaft or blade to a temperature sufficiently high to soften or melt the adhesive and thereby facilitate connection of the replacement blade to, or disconnection of the replacement blade from the shaft. These other devices are electrically powered; thus, a source of electricity is necessary to replace a broken blade or shaft using such devices.

Limited alternative mechanisms exist for connecting certain types of replacement blades to shafts which do not require adhesives. For the most part, however, these alternative connection mechanisms require screws or threaded members to retain the blade relative to the shaft. Such alternative connection mechanisms, are not widely used compared to the conventional method of using a hot melt adhesive.

Thus, there is a need in the art for an improved mechanism for connecting a hockey stick replacement blade to a hockey stick shaft and particularly, a mechanism and a method which eliminates the use of heat sensitive or other adhesive.

SUMMARY OF THE INVENTION

In contrast to the prior art, the present invention relates to an improved, preferably adhesive free mechanism and method for connecting a hockey stick replacement blade to a hockey stick shaft. In accordance with the present invention, the replacement blade includes a connection tenon adapted for insertion into the hollow end of a conventional metal or plastic hockey stick shaft. The tenon is provided with a friction member preferably in the form of an o-ring or other elastic, compressible material which extends outwardly from the outer surface of the tenon. When the tenon is inserted into the hollow connection end of the shaft, the friction member is positioned between the tenon and the interior surface of the shaft to frictionally engage the shaft and retain the blade and the shaft relative to one another without adhesive or other connecting mechanisms.

The invention also relates to a method of connecting the hockey stick replacement blade to a hockey stick shaft which includes the step of providing a replacement blade and a shaft, one of which includes a connection tenon and the other of which includes a tenon receiving hollow interior. The method also includes providing a friction member on the tenon so that a portion of the friction member extends outwardly of the outer surface of the tenon and frictionally engages the interior surface of the tenon receiving interior when the tenon is inserted therein.

Accordingly, it is an object of the present invention to provide an improved hockey stick construction having an improved mechanism for connecting a hockey stick replacement blade to a hockey stick shaft.

Another object of the present invention is to provide a hockey stick replacement blade with a mechanism for connecting such blade to a hockey stick shaft without the use of adhesives.

A still further object of the present invention is to provide a method of connecting a hockey stick replacement blade to a hockey stick shaft, preferably without the use of adhesives.

These and other objects of the present invention will become apparent with reference to the drawings, the description of the preferred embodiment and method and the appended claims.

DESCRIPTION OF THE DRAWINGS

FIG. 1 is a broken apart, isometric view of a hockey stick in accordance with the present invention.

FIG. 2 is an enlarged, broken apart isometric view of the connection portion of the stick between the shaft and the blade.

FIG. 10 is an elevational plan view of an alternate embodiment of a friction member usable in the present invention.

FIG. 11 is a view, partially in section, as viewed along the section line 11—11 of FIG. 10.

FIG. 12 is a fragmentary view, partially in section, showing the friction member of FIGS. 10 and 11 positioned on the tenon.

DESCRIPTION OF THE PREFERRED EMBODIMENT AND METHOD

Figure 3:
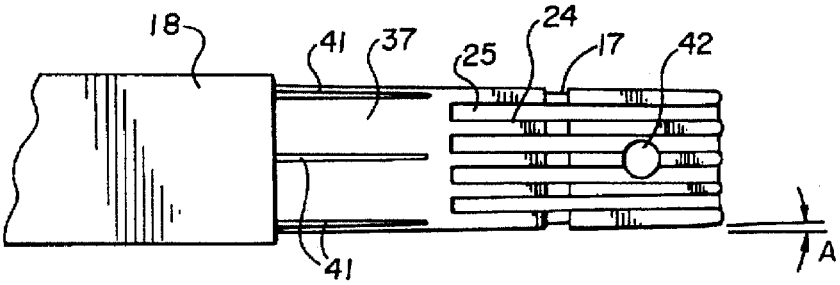
FIG. 3 is an elevational side view of the connection end and tenon of the replacement blade.

Unless otherwise stated, the term "hockey stick" as used throughout the specification and claims shall mean an ice hockey stick, a roller or street hockey stick, a bandy stick or any other sports related stick having a blade and a handle or shaft.

With general reference to FIGS. 1 and 2, and more specific reference to FIGS. 3–9, the hockey stick of the present invention includes an elongated handle or shaft 10 having a first or free end 11 and a second or blade connection end 12. The hockey stick further includes a blade 15 having a blade end 16 and a connection end 18. The connection end 18 is provided with a connection tenon 19. A friction member 17 is positioned between the shaft 10 and the blade 15 to facilitate adhesive free connection of the blade to the shaft.

In the preferred embodiment, the shaft 10 is of conventional design and is constructed of a light weight metal such as aluminum or a plastic, composite or other synthetic material. The shaft 10 has a generally rectangular cross-sectional configuration and includes a hollow tenon receiving interior 20 at its connection end 12. The hollow tenon receiving interior 20 includes an interior surface with a generally rectangular cross-sectional configuration conforming substantially to the rectangular configuration of the exterior surface of the shaft, but with smaller dimensions. The interior 20 includes top and bottom edges and a pair of sides to correspond with the top, bottom and sides of the tenon 17 as described below. The structure and methods of making hockey stick shafts similar to the shaft 10 of the present invention are well known to those skilled in the art. Preferably the shaft 10 is hollow throughout, although it need only be hollow at the connection end 12 to receive the connection tenon 19 as described below.

The blade 15 is commonly referred to as a replacement blade whose general structure is well known in the art. The blade 15 may be constructed of wood or a plastic, composite or other synthetic material. The preferred material, however, is a carbon filled material or a glass filled Nylon material. The blade connection tenon 19 has a generally rectangular cross-sectional configuration with top and bottom edges 35 and 36 and a pair of sides 37 and 38. The edges and sides 35–38 correspond to the top, bottom and sides of the interior surface 20 of the shaft 10. The circumferential dimensions of the edges 35 and 36 and the sides 37 and 38 are approximately the same as, or slightly less than, the circumferential dimensions of the top, bottom and sides of the interior surface 20 to permit the tenon 19 to be inserted into the connection end 12 in connecting relationship. A shoulder 21 is provided between the tenon 19 and a shaft portion of the connection end 18.

In accordance with the present invention, the tenon 19 is preferably provided with a groove 22 extending circumferentially around the entirety of the tenon 19. The groove 22 is adapted to receive the friction member 17 which is carried by the tenon 19. In the preferred embodiment, the friction member 17 is an expandable, closed loop member which, when applied to the tenon 19, seats within the groove 22 with a portion of the member 17 extending outwardly from the outer surface of the tenon 19 as shown best in FIG. 3. In the preferred embodiment, as illustrated best in FIG. 8, the groove 22 has a generally rectangular cross-sectional configuration having a groove base 39 and a pair of groove sides 40, 40. Grooves with other cross-sectional configurations, however, may also be used. The friction member 17 can have a variety of cross-sectional configurations and can be constructed of various materials. One structure is a conventional closed loop rubber o-ring having a generally circular cross-sectional configuration.

Figure 4:
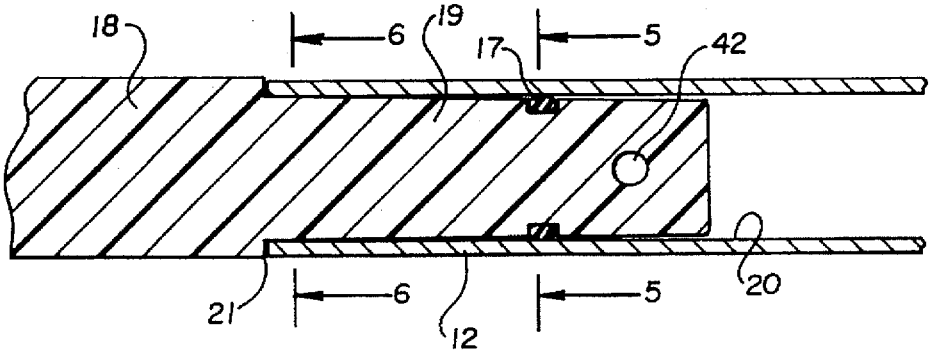
FIG. 4 is a sectional view as viewed along the section line 4—4 of FIG. 2 showing the replacement blade connected with the shaft.
Figure 5:
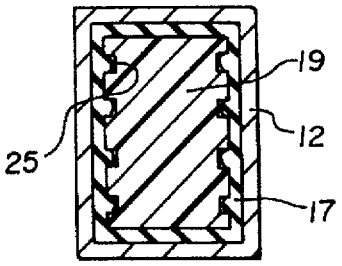
FIG. 5 is a sectional view as viewed along the section line 5—5 of FIG. 4.
Figure 6:
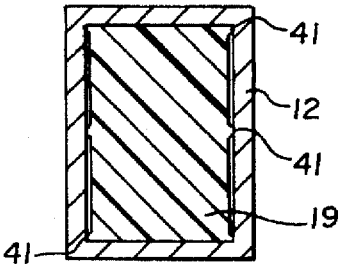
FIG. 6 is a sectional view as viewed along the section line 6—6 of FIG. 4.

When the tenon 19, with the friction member 17 seated thereon, is inserted into the interior 20 of the shaft 10, the member 17 is compressed and is forced into the corners of the groove 22 to permit the tenon 19 to be inserted into the connection end of the shaft 10 as shown best in FIG. 4. Following such insertion, the member 17 is compressed and frictionally engages the surface 20 to retain the blade 15 relative to the shaft 10. Because of the compressibility of the member 17, normal tolerances in the size of the interior surface 20 of the shaft 10 are readily accommodated. The size of the groove 22 and the member 17 will dictate the extent to which the member is compressed upon insertion of the tenon 19 and the extent to which tolerances can be accommodated. Preferably the groove base 39 is about 0.093 inches wide, the grove sides 40, 40 are about 0.05 inches deep and the o-ring 17 is about 0.093 inches in diameter. In the preferred embodiment, the length of the o-ring 17 is such that it requires a slight stretching to be seated within the groove 22, but once seated, returns substantially to its unstretched length.

A further embodiment of the friction member is illustrated in FIGS. 10, 11 and 12. As shown best in FIG. 10, the friction member 44 takes on a generally rectangular closed loop configuration for seating within the groove 22 of the tenon 19. The cross-sectional configuration of this further embodiment is shown best in FIG. 11 and includes an inner tenon engaging surface 45, a pair of side surfaces 46 and 47 and an outer shaft engaging surface 48. The surface 48 is preferably beveled relative to the surface 45 to facilitate sliding of the shaft end 12 onto the tenon 19. As shown best in FIG. 12, the friction member 44 is positioned in the groove 22 with the thinner side surface 47 facing the shaft end 12 and the thicker side surface 46 facing the blade end. With this positioning, the beveled surface 48 provides a ramp or lead in for ease in sliding the shaft onto the tenon, but renders it more difficult for the shaft to be removed. Preferably, the friction member 44 is constructed of a compressible, rubbery material with a closed loop dimension slightly smaller than the circumferential dimension of the groove 22. This requires a slight expansion of the member 44 to fit within the groove 22.

In the preferred embodiment, the friction member is disposed in a circumferential groove extending around the tenon. Benefits of the present invention can, however, be realized by positioning or securing the friction member directly to the outer surface of the tenon 19. Further, the friction member is preferably a closed loop member which provides a friction member portion on all four sides of the tenon. The friction member, however, can be comprised of one or more friction member sections secured to a plurality of the tenon sides.

Figure 7:
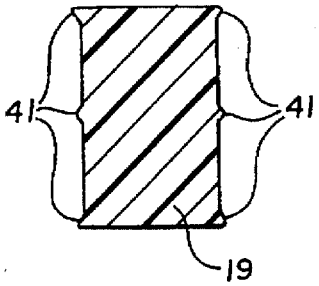
FIG. 7 is a sectional view as viewed along the section line 7—7 of FIG. 2.
Figure 8:
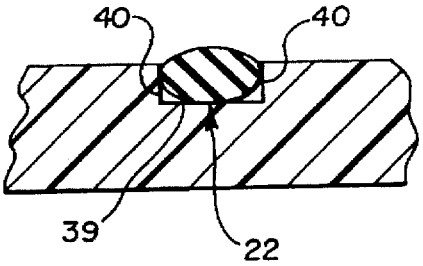
FIG. 8 is an enlarged side view of a portion of the replacement blade tenon showing the configuration of the groove for the friction member.
Figure 9:
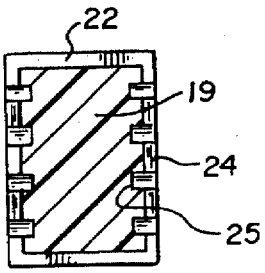
FIG. 9 is a sectional view as viewed along the section line 9—9 of FIG. 2.

As shown best in FIGS. 2, 3 and 7, the sides 37 and 38 of the tenon 19 are preferably provided with a plurality of crush ribs 41 extending generally parallel to the axis of the tenon 19. These ribs 41 extend outwardly from the main surface of the sides 37 and 38 and are relatively narrow and of decreasing height as they extend toward the free end of the tenon 19. The ribs 41 function to accommodate tolerances in the size of the interior surface 20 of the shaft 10. During insertion of the tenon 17 into the hollow interior 20, the ribs 41 are crushed or deformed by the interior surface 20 to provide a tight fit. The extent of deformation of the ribs 41 depend on variances in the exact size of the interior 20. Although the ribs 41 are shown in the preferred embodiment, they may be omitted in some embodiments.

The tenon 19 is also preferably provided with a slight taper or draft represented by the angle "a" in FIG. 3. This taper or draft is provided primarily as a lead in for inserting the tenon 19 into the hollow interior 20. The taper or draft, in conjunction with the size of the groove 22 and member 17, can also be provided to accommodate the compressed member 17. The preferred taper results in the dimension of the outer or free end of the tenon 19 being about 0.030 inches less than the dimension of the tenon where it connects with the blade. Preferably the groove 22 and friction member 17 are positioned closer to the free end of the tenon 19 than the end which joins with the main blade portion.

The sides 37 and 38 of the tenon 19 are provided with a plurality of alternate ribs and grooves 24 and 25 extending parallel to the longitudinal axis of the tenon 19. These grooves 25 are provided primarily for weight control, although the grooves 25 also provide a recess for receiving a portion of the compressed friction member when the shaft is connected. As shown best in FIG. 9, the friction member groove 22 extends through the ribs and grooves 24 and 25. A hanger hole 42 is provided to hang the blade for display purposes.

Having described the structure of the mechanism of the present invention for connecting a replacement blade to a hockey stick shaft, the method can be described as follows. First, a hockey stick shaft having a hollow blade connection end and a hockey stick replacement blade having a connection tenon with an exterior surface are provided. A friction member is also provided and is positioned on the tenon so that a portion of the friction member extends outwardly from the exterior surface of the tenon. Finally, the tenon, with the friction member positioned thereon, is inserted into the hollow blade connection end of the shaft with the friction member positioned therebetween. During such insertion, the friction member is compressed and frictionally engages the inner surface of the connection end, thereby retaining the blade relative to the shaft.

Although the description of the preferred embodiment has been quite specific, it is contemplated that various modifications may be made without deviating from the spirit of the present invention. For example, the tenon 19 and shaft 10 have been shown to have a generally rectangular configuration. It is understood that the advantages of the present invention can be achieved with different cross-sectional configurations such as oval, square, circular or the like. Further, the preferred embodiment describes the improved blade/shaft connection mechanism with a shaft having a hollow connection end, a blade having a connection tenon and a friction member disposed between such elements. It is also contemplated, however, that the benefits of the present invention can be achieved with a replacement blade having a hollow connection end, a shaft having a connection tenon and a friction member disposed therebetween. Further, the preferred embodiment has been shown with a single friction member; however, multiple friction members may be utilized also. Still further, although the present invention is designed primarily as an adhesive free connection, adhesive could be used as a supplement, if desired.

Accordingly, it is intended that the scope of the present invention be dictated by the appended claims rather than by the description of the preferred embodiment.

I claim:

1. A hockey stick comprising:

an elongated shaft having a blade connection end;

a blade having a shaft connection end, one of said blade connection end and said shaft connection end having a hollow tenon receiving interior with an interior surface and interior dimensions and the other of said blade connection end and said shaft connection end having a connection tenon with an exterior surface comprising an outermost surface of said connection tenon and exterior dimensions of said tenon, said exterior dimensions being slightly smaller than said interior dimensions to facilitate selective insertion of said connection tenon into said hollow tenon receiving interior, said shaft and said blade being connected when said tenon is inserted into said tenon receiving interior and disconnected when said tenon is not inserted into said tenon receiving interior;

at least one compressible friction member carried by said tenon and having a portion extending outwardly from said exterior surface when said shaft and said blade are disconnected, said portion extending outwardly from said exterior surface a distance sufficient to be compressed upon insertion of said connection tenon into said hollow tenon receiving interior, and said friction member being free of connection with any adjustment means and being compressible solely as a result of insertion of said connection tenon into said hollow tenon receiving interior, whereby said friction member is compressed and engages said interior surface when said tenon is inserted into said hollow interior to retain said blade in operative engagement with said shaft.

2. The hockey stick of claim 1 wherein said tenon has a longitudinal axis and includes a plurality of alternating ribs and grooves extending in the direction of said longitudinal axis.

3. The hockey stick of claim 1 wherein said tenon includes a groove for seating said friction member.

4. The hockey stick of claim 1 wherein said friction member portion includes an outer, beveled surface for engagement with said interior surface.

5. The hockey stick of claim 1 wherein said blade connection end has,said tenon receiving interior and said shaft connection end has said tenon.

6. The hockey stick of claim 1 wherein said blade connection end comprises a wall defining said tenon receiving interior and wherein said wall is free of any apertures extending through said wall.

7. A replacement blade for a hockey stick comprising:

a blade portion having a toe and a heel;

a connection end having a connection tenon with an exterior surface and a longitudinal axis, at least a portion of said exterior surface being provided with a plurality of alternating ribs and grooves extending in the direction of said longitudinal axis; and a friction member carried by said tenon and having a portion extending outwardly from said exterior surface.

8. The replacement blade of claim 7 wherein said tenon includes a circumferential groove for receiving said friction member.

9. The replacement blade of claim 7 wherein said friction member is constructed of a compressible material.

10. The replacement blade of claim 7 wherein said friction member includes an outer beveled surface.

11. The replacement blade of claim 10 wherein said beveled surface is beveled outwardly from said exterior surface in the direction of said blade portion.

12. A method of connecting a replacement hockey blade to a hockey stick shaft comprising:

providing an elongated shaft having a blade connection end, said blade connection end having a hollow tenon receiving interior with an interior surface;

providing a blade having a shaft connection end, said shaft connection end having a connection tenon with an exterior surface and exterior dimensions, said shaft and blade being selectively connectable by insertion of said connection tenon into said tenon receiving interior;

providing said connection tenon with at least one compressible friction member having a portion extending outwardly from said exterior surface when said shaft and blade are disconnected, said portion extending outwardly a sufficient distance so that upon insertion of said connection tenon into said hollow tenon receiving interior, such insertion results in said friction member being compressed;

compressing said friction member by inserting said connection tenon into said hollow tenon receiving interior, whereby said friction member is compressed and engages said interior surface during said insertion, whereby said blade is retained in operative engagement with said shaft by said compressed friction member.

* * * * *